United States Patent [19]

Hirose et al.

BEST AVAILABLE COPY

[11] Patent Number: 4,473,157

[45] Date of Patent: Sep. 25, 1984

[54] AUTOMATIC BANK NOTE TRANSACTION APPARATUS

[75] Inventors: Minoru Hirose, Yokohama; Hiroyuki Kubotera, Kanagawa, both of Japan

[73] Assignee: Tokyo Shibaura Kenki Kabushiki Kaisha, Kawasaki, Japan

[21] Appl. No.: 337,754

[22] Filed: Jan. 7, 1982

[30] Foreign Application Priority Data

Jan. 22, 1981 [JP] Japan ..... 56-8522

[51] Int. Cl.[3] ..... B07C 5/02

[52] U.S. Cl. ..... 209/534; 209/541; 209/548; 271/4; 271/305; 271/315

[58] Field of Search ..... 209/534, 541, 942, 934, 209/551, 548, 549; 194/4 R, 4 B–4 G; 271/3.1, 4, 303, 305, 181, 187, 315; 414/37, 46, 104

[56] References Cited

U.S. PATENT DOCUMENTS

| | | | |
|---|---|---|---|
| 3,731,799 | 5/1973 | Meloni et al. | 209/534 |
| 3,917,260 | 11/1975 | Okkonen et al. | 271/181 |
| 3,966,047 | 6/1976 | Steiner | 209/534 |
| 4,011,931 | 3/1977 | Wyckoff | 209/534 |
| 4,096,991 | 6/1978 | Iguchi | 209/534 |

FOREIGN PATENT DOCUMENTS

| | | | |
|---|---|---|---|
| 113399 | 9/1979 | Japan | 209/534 |
| 119775 | 9/1980 | Japan . | |
| 1047056 | 11/1966 | United Kingdom | 271/181 |
| 1370972 | 10/1974 | United Kingdom . | |
| 2025106 | 1/1980 | United Kingdom | 209/534 |
| 2094531 | 9/1982 | United Kingdom | 209/534 |

*Primary Examiner*—Robert B. Reeves
*Assistant Examiner*—Donald Hajec
*Attorney, Agent, or Firm*—Cushman, Darby & Cushman

[57] ABSTRACT

An automatic bank note transaction apparatus comprises a discriminator for discriminating fit notes from unfit notes among the bank notes conveyed by a conveyance path, and identifying the denomination of the fit notes, sorting gates for sorting the bank notes according to the result of discrimination by a discriminator, and distributing the fit notes by denomination, temporary collecting sections for temporarily collecting the bank notes sorted by the sorting gates, storage chambers for storing bank notes of each denomination judged to be fit, a return path for returning the bank notes collected in the temporary collecting sections to a return outlet of a housing, and shutters located between the temporary collecting sections and the storage chambers for guiding the temporarily collected bank notes into the storage chambers when a user approves depositing or into the return path when the user disapproves depositing.

6 Claims, 4 Drawing Figures

AUTOMATIC BANK NOTE TRANSACTION APPARATUS

BACKGROUND OF THE INVENTION

This invention relates to an automatic bank note transaction apparatus such as an automatic depositing machine, automatic withdrawing machine, more specifically to an automatic bank note transaction apparatus provided with both depositing and withdrawing functions.

Automatic depositing machines, automatic withdrawing machines, etc., have recently been developed and put to practical use to achieve reduction of labor for service at the window in banks. Initially, very few customers tried the apparatus of this kind because of the unfamiliarity and distrust of the apparatus and the operation thereof. In these days, however, users of such apparatus, as well as transactions thereon, are increasing remarkably as the apparatus become more familiar. Conventionally, in the automatic bank note transaction apparatus, bank notes inserted through a cash inlet are introduced and transferred one by one. The introduced bank notes are subjected to true/false discrimination, superposed-note detection, etc., and fit notes are discriminated from unfit notes. Thereafter, the fit notes are sorted by denomination, and collected in temporary collecting sections formed over a cashbox. The unfit notes are collected in a return outlet to be returned to a user. If the user approves transaction, that is, if the user pushes an approval button, gates serving as bank notes bearer in the temporary collecting sections slide and shutters are opened, and the fit bank notes collected temporarily in the collecting sections drop into the cashbox to be stacked therein. If the user disapproves the transaction and pushes a disapproval button, on the other hand, depressing plates slide without opening the shutters, and the bank notes collected in the temporary collecting sections are delivered into a return path, and returned to the return outlet.

However, the denominations and arrangement sequence of the bank notes collectively put in the apparatus vary with every user, so that the bank notes in the cashbox are arranged at random. Accordingly, a clerk in charge of money collection need rearrange the bank notes in the cashbox. Thus, the prior art apparatus require extremely troublesome and time-consuming operations.

SUMMARY OF THE INVENTION

This invention is contrived in consideration of these circumstances, and is intended to provide an automatic bank note transaction apparatus capable of separately storing deposited bank notes according to denomination, requiring hardly any troublesome rearrangement of the stored bank notes, and capable of collectively returning bank notes temporarily collected according to denomination to a user, thereby eliminating complicated user operations and the possibility of the user's leaving the bank notes in the apparatus.

According to an aspect of the invention, there is provided an automatic bank note transaction apparatus which comprises a housing having a cash inlet through which bank notes are put in and a return outlet through which the bank notes are taken out; receiving means for collectively receiving the bank notes put in through the cash inlet; conveyance means for successively introducing and conveying the bank notes in the receiving means one by one; discriminating means for discriminating fit notes from unfit notes among the bank notes conveyed by the conveyance means, and identifying the denomination of the fit notes; sorting means for sorting the bank notes according to the result of the discrimination by the discriminating means, and distributing the fit notes by denomination; temporary collecting sections for temporarily collecting the bank notes sorted by the sorting means; storage chambers each having an inlet opposed to the outlet of its corresponding temporary collecting section and storing bank notes of each denomination judged to be fit; a return path for returning the bank notes collected in the temporary collecting sections to the return outlet; and distributing means located between the outlets of the temporary collecting sections and the inlets of the storage chambers, the temporarily collected bank notes being led into the storage chambers when a user approves depositing, or the temporarily collected bank notes being led into the return path when the user disapproves depositing, whereby the bank notes temporarily collected in the temporary collecting sections are collectively returned to the return outlet through the return path in the case of the user's disapproval.

In the apparatus of the invention, the deposited bank notes can be stored by denomination, so that a clerk in charge need not rearrange the bank notes in the cashbox, and may substantially save himself trouble. In the case of the user's disapproval of depositing, moreover, the bank notes temporarily collected according to denomination may be returned to the user in one lot. Thus, the user operations are simplified, and the user may be kept from leaving his money behind.

Further, the apparatus of the invention is so designed as to bias the bank notes returned to the return outlet. Accordingly, the collection of the bank notes to be returned to the user in the return outlet may securely be executed in good order.

DETAILED DESCRIPTION OF THE PREFERRED EMBODIMENT

Now there will be described in detail an automatic bank note transaction apparatus according to one embodiment of this invention with reference to the accompanying drawings.

Figure 1:
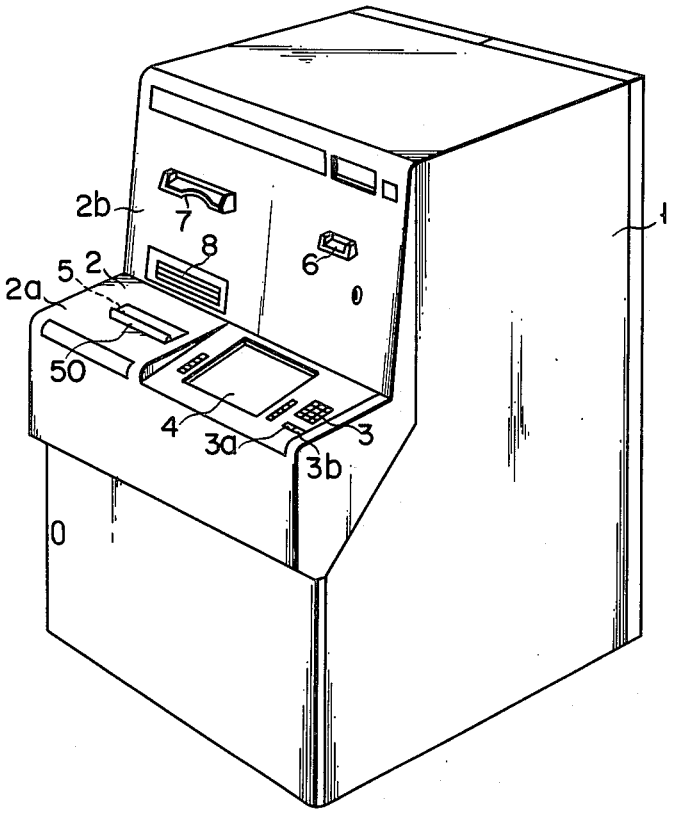
FIG. 1 is a perspective view showing the external appearance of an automatic bank note transaction apparatus according to one embodiment of this invention.

In FIG. 1, reference numeral 1 designates a housing of an automatic depositing/withdrawing machine as the automatic bank note transaction apparatus. Formed on the front side of the housing 1 is a user-service section 2 which includes a horizontal control board 2*a* located substantially halfway between the top and bottom of the housing 1, and a vertical control board 2*b* rising from the rear edge of the horizontal control board 2*a*. Arranged on the horizontal control board 2*a* are a keyboard 3, a CRT display unit 4, and a cash inlet slot 5 doubling as a return outlet. Arranged on the vertical control board 2*b*, on the other hand, are a card inlet slot 6, a passbook inlet slot 7, and a cash outlet slot 8. The keyboard 3 is provided with an approval button 3*a* and a disapproval button 3*b*.

Further, the housing 1 contains therein a card reader (not shown) for reading information on an ID card inserted through the card inlet slot 6, a passbook reader-printer (not shown) for reading a magnetic stripe on a passbook inserted through the passbook inlet slot 7 and recording transaction details on the passbook, a withdrawing mechanism (not shown) for delivering to the cash outlet slot 8 bank notes P corresponding to a designated amount, and a depositing mechanism 9 for depositing bank notes P inserted in the cash inlet slot 5.

Figure 2:
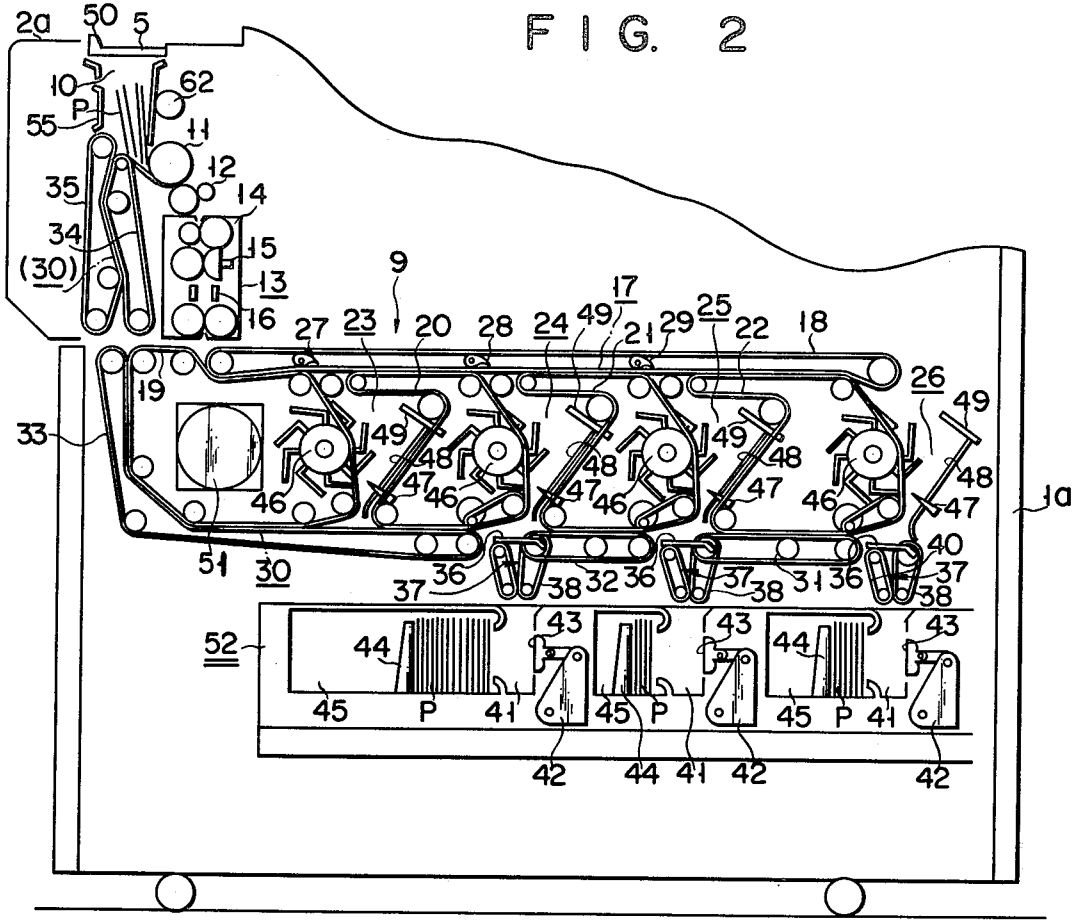
FIG. 2 is a side view showing an outline of a depositing mechanism in the apparatus shown in FIG. 1.
Figure 3:
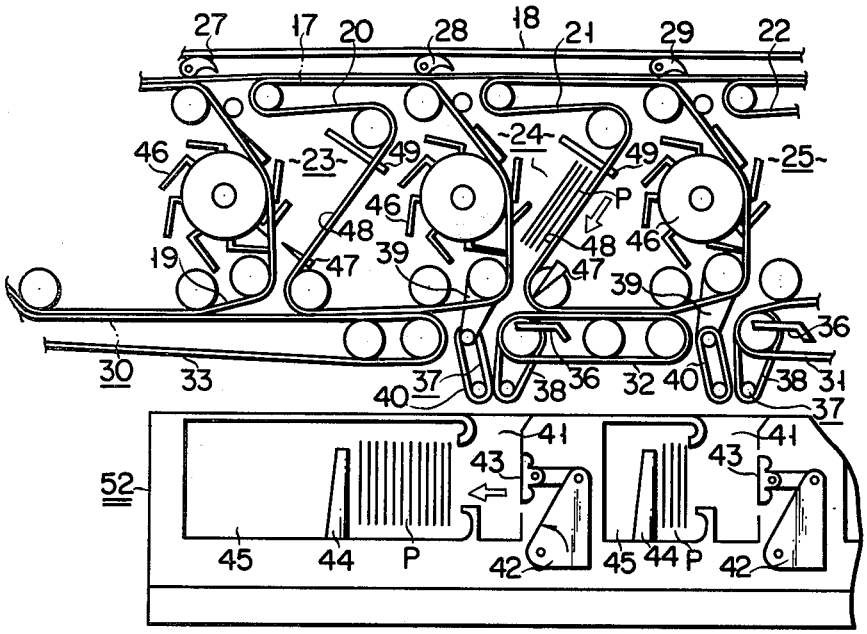
FIG. 3 is an enlarged side view showing the principal part of the mechanism shown in FIG. 2.

The depositing mechanism 9 is constructed as shown in FIGS. 2 and 3. Inside the housing 1, a bank note receiving section 10 is disposed opposite to the cash inlet slot 5. The bottom plate of the bank note receiving section 10 is declined toward the inner side (right-hand side of FIG. 2). An introduction roller 11 is disposed on the bottom plate at the lower end side thereof. A bank note P located in the innermost part of the bank note receiving section 10 is taken in diagonally downward. Then, the bank note P is transferred to a bank note discriminator 13 by means of a pair of transfer rollers 12. The introduction roller 11 and the pair of transfer rollers 12 constitute introduction-conveyance means. The bank note discriminator 13, which discriminates the bank note P taken in and transferred by the introduction-conveyance means, includes a thickness detecting section 14, a magnetism detecting section 15, and a width/length detecting section 16.

The starting portion of an introduction-conveyance path 17 underlies the bank note discriminator 13. The bank note P passed through the bank note discriminator 13 is introduced and carried deep into the housing 1 through the introduction-conveyance path 17. The introduction-conveyance path 17 is formed of facing portions between a first endless conveyor belt 18 stretched substantially horizontally and second, third, fourth and fifth endless conveyor belts 19, 20, 21 and 22 parts of which are in contact with the under surface of the first endless belt 18. A first temporary collecting section 23 for unfit notes is defined between facing sections of the second and third endless belts 19 and 20; a second temporary collecting section 24 for first-denomination notes (e.g., 100-dollar or 10-pound notes) between the third and fourth endless belts 20 and 21, a third temporary collecting section 25 for second-denomination notes (e.g., 50-dollar or 5-pound notes) between the fourth and fifth endless belts 21 and 22, and a fourth temporary collecting section 26 for third-denomination notes (e.g., 10-dollar or 1-pound notes) between the fifth endless belt 22 and the inner wall surface of a back door 1*a* of the housing 1.

In the middle of the introduction-conveyance path 17 are arranged first, second and third sorting gates 27, 28 and 29 as sorting means for selectively leading the bank notes being carried into the first, second, third and fourth temporary collecting sections 23, 24, 25 and 26 according to the unfitness or denomination of each note.

Further, the middle portion of a return path 30 underlies the temporary collecting sections 23, 24, 25 and 26. The return path 30 is intended to return the temporarily collected bank notes P to the bank note receiving section 10 as required. The return path 30 is defined by facing portions between the fifth endless conveyor belt 22 and a sixth endless conveyor belt 31, between the fourth endless conveyor belt 21 and a seventh endless conveyor belt 32, between the third and second endless conveyor belts 20 and 19 and an eighth endless conveyor belt 33, and between ninth and tenth endless conveyor belts 34 and 35, and by the respective top surfaces of shutters 36 as distributing means severally facing the outlets of the second, third and fourth temporary collecting sections 24, 25 and 26.

Under the shutters 36 lie delivery mechanisms 37 which deliver the temporarily collected bank notes P to a cashbox 52 disposed at the lower portion of the interior of the housing 1. As shown in FIG. 3, the delivery mechanisms 37 each includes an eleventh endless conveyor belt 38 and a twelfth endless conveyor belt 40, which, facing the eleventh endless belt 38, is caused to engage or be disengaged from the eleventh endless belt 38 by the rocking motion of a roller support arm 39. The delivery mechanisms 37 can hold the bank notes P in bundles and deliver them to their corresponding inlets 41 of the cashbox 52 as they are kept in an upright position. A push mechanism 42 is provided for each of the inlets 41. The push mechanism 42 is so constructed as horizontally to push by means of a pusher 43 the bank notes P inserted in the inlet 41 into a storage chamber 45 against the urging force of a backup member 44.

The temporary collecting sections 23, 24, 25 and 26 each includes an impeller 46, a gate 47 doubling as a bearer to support the lower edges of the bank notes P supplied successively by means of the impeller 46, a guide plate 48 maintaining the bank notes P supported by the gate 47 in a substantially upright position, and a depressing plate 49 telescopically attached to the guide plate 48 substantially at right angles to the guide surface thereof, whereby the upper edges of the collected bank notes P are pressed down when the gate 47 is opened.

In FIG. 2, reference numeral 50 designates a cover to open and close the cash inlet slot 5 doubling as the return outlet, and reference numeral 51 denotes a motor as a driving source for the conveyor system.

Figure 4:
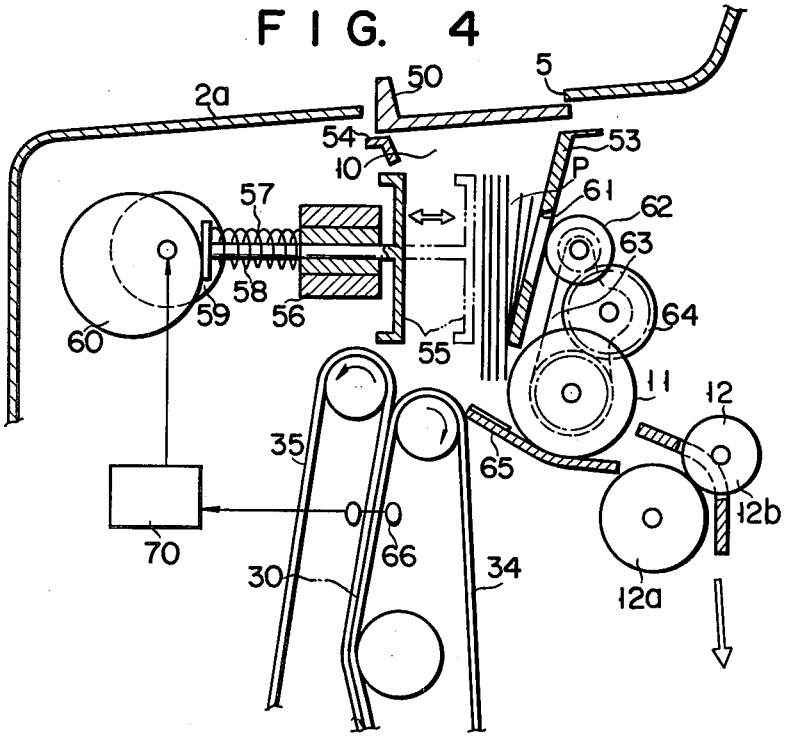
FIG. 4 is an extractive side view of a bank note receiving section in the apparatus of FIG. 1.

Referring now to FIG. 4, there will be described the arrangements of the bank note receiving section 10 and other members or mechanisms surrounding the same. The bank note receiving section 10 is defined by a rear fixed guide plate 53 extending along the rear edge portion of the cash inlet slot 5 a front fixed guide plate 54 facing the rear fixed guide plate 53, and a movable guide plate 55 functioning as both a backup plate and a push board. The movable guide plate 55 is attached to the rear end portion of a shaft 58 which is always urged forward by a spring 57 and can slide axially through a shaft guide 56. The shaft 58 is mounted to be displaced by the rotation of an eccentric cam 60 which is driven by a motor 59. The drive of the motor 59 is controlled by a control circuit 70. By the displacement of the shaft 58, the movable guide plate 55 is selectively shifted between a position corresponding to the front edge of the cash inlet slot 5, i.e., the position represented by solid line in FIG. 4 which allows the bank notes P to be inserted through the cash inlet slot 5 or to be returned from the return path 30, and a position represented by two dots and dash line where the bank notes P are held against the rear fixed guide plate 53. Thus, the receiving section 10 is provided with biasing means for biasing the returned bank notes P toward the fixed guide plate 53.

A roller window 61 is formed in the rear fixed guide plate 53. At the back of the rear fixed guide plate 53, a feed roller 62 is attached to the free end portion of a rocking arm 63 which rocks around the shaft of the introduction roller 11. The feed roller 62 is linked to the introduction roller 11 by means of a gear mechanism 64. The feed roller 62 comes in rolling contact with one of the bank notes P touching the rear fixed guide plate 53 inside the bank note receiving section 10, thereby causing the bank note P to be let out downward and fed between the introduction roller 11 and a bottom guide plate 65.

In FIG. 4, reference numeral 66 denotes a bank note passage detector at the end of the return path 30, and reference numerals 12*a* and 12*b* designate a driving roller and a pressure roller, respectively, constituting the pair of transfer rollers 12.

Now there will be described the operation of the above-mentioned embodiment. First, a user who intends to deposit money in the apparatus according to the operating instructions pushes a deposit key among several selector keys (e.g., deposit key, withdraw key, balance inquiry key, etc.) on the keyboard 3. Then, the apparatus is set to receive a passbook, and the CRT display unit 4 displays a message to that effect.

Subsequently, when the user inserts his passbook into the passbook inlet slot 7, the passbook is automatically introduced into the housing 1. Then, the passbook reader-printer (not shown) reads the magnetic stripe on the passbook to collate the account number and other information. When the collation is ended, the apparatus is set to receive money, and the cover 50 over the cash inlet slot 5 slides open. Then, the user puts a bundle of bank notes P at once into the cash inlet slot 5, and thereafter restores the cover 50 to close the slot 5. When a detector (not shown) detects the closing of the cash inlet slot 5, the bank notes P start to be taken into the housing 1. Namely, when it is detected that the cash inlet slot 5 is covered, the control circuit 70 causes the motor 59 to make ½ revolution, so that the maximum-eccentricity portion of the eccentric cam 60 faces the end portion of the shaft 58. Accordingly, the movable guide plate 55 is moved to the pressing position represented by two dots and dash line in FIG. 4. Then, the pile of bank notes P in the bank note receiving section 10 is pushed toward the rear fixed guide plate 53 by the movable guide plate 55, and that one of the bank notes P which faces the rear fixed guide plate 53 is pressed thereon.

Subsequently, when it is detected by a detector (not shown) that the movable guide plate 55 is moved to the pressing position (represented by two dots and dash line) inside the bank note receiving section 10, the feed roller 62 is displaced to come in rolling contact with the aforesaid one bank note P. Then, the introduction roller 11 and the feed roller 62 linked thereto start intermittent rotation to introduce the bank notes P one by one into the interior of the apparatus. The introduced bank notes P are subjected to thickness detection, magnetism detection, and width/length detection as they pass through the bank note discriminator 13. Thus, checking of superposed-sheet introduction, discrimination between fit and unfit notes, and counting are performed. Those bank notes P′ which are superposed, unidentifiable or uncountable, and hence are rejectable, are sorted from the introduction-conveyance path 17 to the first temporary collecting section 23 by the first sorting gate 27, and are collected temporarily in the collecting section 23. Among those bank notes P or fit notes which are judged to be fit, first-denomination notes are sorted by the second sorting gate 28 to the second temporary collecting section 24 to be collected temporarily therein. Likewise, second-denomination notes are sorted by the third sorting gate 29 to the third temporary collecting section 25 to be collected temporarily therein, and third-denomination notes advance in a beeline on the introduction-conveyance path 17 to be collected temporarily in the fourth temporary collecting section 26.

Meanwhile, when it is detected by a detector (not shown) that all the bank notes P inserted through the cash inlet slot 5 are introduced into the interior of the apparatus, the introduction roller 11 stops intermittent rotation, and the control circuit 70 causes the motor 59 to make additional ½ revolution. Accordingly, the minimum-eccentricity portion of the eccentric cam 60 faces the end portion of the shaft 58, so that the movable guide plate 55 returns to the position represented by solid line in FIG. 4. Thus, the introduction process is ended.

If the rejected notes P′ are collected in the first temporary collecting section 23, the gate 47 doubling as the bearer to support the lower edges of the rejected notes P′ is opened. In this state, the depressing plate 49 moves downward. Then, the temporarily collected rejected notes P′ are delivered into the return path 30, and returned to the bank note receiving section 10.

When the rejected notes P′ are returned to the bank note receiving section 10, the introduction roller 11 and the feed roller 62 start intermittent rotation in the same manner as aforesaid. Then, the rejected notes P′ are introduced one by one into the interior of the apparatus, and subjected again to the true/false discrimination by the bank note discriminator 13.

If any unfit notes are left in the first temporary collecting section 23 after the aforementioned process is repeated a plurality of times, e.g., twice, they are returned to the bank note receiving section 10 through the return path 30 in the same manner as aforesaid. Then, the cover 50 slides to open the cash inlet slot 5 doubling as the return outlet so that the bank notes may be returned to the user. At this time, the CRT display unit 4 displays a message "UNIDENTIFIABLE NOTE IS INVOLVED. ASK FOR WINDOW SERVICE," for example. Then, the user is expected to withdraw the rejected notes P′ in the bank note receiving section 10 right under the cash inlet slot 5.

Thus, the repeated true/false discrimination of the temporarily rejected notes P′ may reduce the possibility of wrong judgment. On the other hand, the user is required only to put in and remove the bank notes P once. Accordingly, the operation is simplified and facilitated, and the reduced processes of user operation may lead to shorter transaction time.

If it is detected by a detector (not shown) that the rejected notes P′ are removed from the return outlet or cash inlet slot 5 by the user, or if there are no rejected notes P′, the CRT display unit 4 displays the received amount in this stage. Then, if the user pushes the approval key 3*a* on the keyboard 3, approval of the displayed amount is inputted. In case of disapproval, the disapproval key 3*b* is to be pushed.

When the approval key 3*a* is pushed, the bearer or gate 47, the roller support arm 39 of the delivery mechanism 37, and the shutter 36 forming part of the return path 30 operate so that the bank notes P can be delivered to the side of the cashbox 52, as shown in FIG. 3. Then, the depressing plate 49 is moved in the direction of the arrow to push out the bank notes P. The pushed bank notes P are delivered into the corresponding inlet 41 of the cashbox 52 by means of the corresponding delivery mechanism 37. The bank notes P delivered to the inlet 41 are then caused to be stored in the corresponding storage chamber 45 by means of the push mechanism 42. The transfer of the bank notes P from the temporary collecting sections 24, 25 and 26 for the notes of the several denominations to their corresponding storage chambers 45 is performed in the same manner and at the same time.

When the disapproval key 3*b* is pushed, all gates 47 and depressing plates 49 operate in the same manner as the case of approval. As for the roller support arms 39 of the delivery mechanism 37 and the shutters 36, however, they remain in the position shown in FIG. 2, thereby causing the bank notes P of the several denominations to be returned successively to the bank note receiving section 10 through the return path 30. Then, the cover 50 slides to open the return outlet or cash inlet slot 5. Namely, when the disapproval key 3*b* is depressed, the first-denomination notes P temporarily collected in the second temporary collecting section 24 are first returned to the bank note receiving section 10 through the return path 30. When the first-denomination notes P are returned to the bank note receiving section 10, the control circuit 70 causes the motor 59 to make ½ revolution. Then, the movable guide plate 55 is moved to the position represented by two dots and dash line in FIG. 4, so that the first-denomination notes P are pressed against the fixed guide plate 53 on the side where the introduction roller 11 and the feed roller 62 are disposed. Subsequently, the second-denomination notes P temporarily collected in the third temporary collecting section 25 are returned to the bank note receiving section 10 through the return path 30. At this time, the second-denomination notes P pass through the bank note passage detector 66, so that the control circuit 70 causes the motor 59 to make additional ½ revolution. Accordingly, the movable guide plate 55 returns to the position represented by solid line in FIG. 4. Thus, a sufficient space is kept between the back of the last one among the first-denomination notes P previously returned to the bank note receiving section 10 and the movable guide plate 55. Accordingly, the second-denomination notes P can be returned to the bank note receiving section 10 without running against the first-denomination notes P. Likewise, the third-denomination notes P temporarily collected in the fourth temporary collecting section 26 are returned to the bank note receiving section 10, and regularly collected at the back of the second-denomination notes.

When all the bank notes P including the first-, second- and third-denomination notes are returned to the bank note receiving section 10, the cover 50 is removed from the return outlet or cash inlet slot 5 so that the received bank notes P may collectively be returned to the user. As a result, the user can withdraw all the returned bank notes P by a single operation.

Thus, the processing of the bank notes P is ended. If the displayed amount is approved, transaction details are recorded on the passbook by the passbook reader-printer. Thereafter, the passbook is returned to the passbook inlet slot 7, and thus all the operations for the depositing transaction are completed.

Although in the above embodiment the automatic bank transaction apparatus of this invention is applied to the automatic depositing/withdrawing machine, the invention may also be applied to an automatic depositing machine, naturally. It is to be understood, moreover, that the invention is not limited to the above-mentioned embodiment, and that various changes and modifications may be effected therein by one skilled in the art without departing from the scope or spirit of the invention.

What we claim is:

1. An automatic bank note transaction apparatus comprising:

a housing having a cash inlet/output port through which bank notes are put in and taken out;

receiving means for collectively receiving the bank notes put in through said cash inlet/outlet port, said receiving means including biasing means for biasing the bank notes received therein in one direction;

conveyance means for successively introducing and conveying the bank notes in said receiving means one by one, wherein said conveyance means includes an introduction roller for introducing the bank notes one by one into the interior of said apparatus, and wherein said biasing means includes a back-up plate for pressing the bank notes against said introduction roller, said back-up plate deviating the bank notes returned through a return path and received in aaid receiving means from an extension of said return path;

discriminating means for discriminating fit notes from unfit notes among the bank notes conveyed by said conveyance means, and identifying the denomination of said fit notes;

sorting means for sorting the bank notes according to the result of the discrimination by said discriminating means and further sorting the fit notes by denomination;

temporary collecting sections for temporarily collecting the bank notes sorted by said sorting means, each of said temporary collecting sections having an outlet;

storage chambers each having an inlet opposed to the outlet of its corresponding temporary collecting section and storing bank notes of each denomination judged to be fit;

return means for returning the bank notes collected in said temporary collecting sections to said receiving means; and distributing means located between the outlets of said temporary collecting sections and the inlets of said storage chambers for guiding the temporarily collected bank notes into said storage chambers when a user approves depositing and into said return means when the user disapproves depositing;

whereby the bank notes temporarily collected in said temporary collecting sections are collectively returned to said receiving means through said return means in the case of the user's dissapproval, and the unfit notes returned to the receiving means through the return means are again conveyed to the discriminating means through the conveyance means to be discriminated again by the discriminating means.

2. The automatic bank note transaction apparatus according to claim 1, wherein said distributing means includes movable shutters corresponding severally to said storage chambers, each said shutter moving to a position where said shutter opens the inlet of its corresponding storage chamber and causes the bank notes to be led into said inlet when depositing is approved, and moving to a position where said shutter blocks up said inlet and causes the bank notes to be led into said return path when depositing is disapproved.

3. The automatic bank note transaction apparatus according to claim 2, wherein each said temporary collecting section is provided with a depressing plate for pushing out the bank notes collected in said collecting section through the outlet thereof when depositing is either approved or disapproved.

4. The automatic bank note transaction apparatus according to claim 3, wherein said depressing plate is driven to push out the bank notes that are temporarily collected at one time when depositing is either approved or disapproved.

5. The automatic bank note transaction apparatus according to claim 1, wherein said backup plate is a common plate member.

6. The automatic bank note transaction apparatus according to claim 5, wherein said common plate member moves to press the bank notes against said introduction roller when said bank notes cease from being inserted through said inlet/outlet part, and to press the bank notes in lots against said introduction roller when said bank notes are returned in lots through said return path.

* * * * *